US005317231A

United States Patent [19]

Lee

[11] Patent Number: 5,317,231

[45] Date of Patent: May 31, 1994

[54] PLASMA DISPLAY DEVICE

[75] Inventor: Sang-rok Lee, Seoul, Rep. of Korea

[73] Assignee: Samsung Electron Devices, Co., Ltd., Kyunggi-do, Rep. of Korea

[21] Appl. No.: 785,107

[22] Filed: Oct. 30, 1991

[30] Foreign Application Priority Data

Nov. 2, 1990 [KR] Rep. of Korea ..... 90-17768

[51] Int. Cl.[5] ..... H01J 17/49

[52] U.S. Cl. ..... 313/493; 313/491; 313/492; 313/494; 313/268

[58] Field of Search ..... 313/493, 491, 492, 494, 313/500, 505, 250, 258, 267, 268, 284, 288, 326; 340/758, 759

[56] References Cited

U.S. PATENT DOCUMENTS 3,882,342 5/1975 Kamegaya et al. ..... 313/491 X
4,005,402 1/1977 Amano ..... 313/491 X
4,446,399 5/1984 Endo et al. ..... 313/505
4,659,963 4/1987 Huber ..... 313/493
5,138,225 8/1992 Kim ..... 313/491 X

*Primary Examiner*—Donald J. Yusko
*Assistant Examiner*—Ashok Patel
*Attorney, Agent, or Firm*—Leydig, Voit & Mayer

[57] ABSTRACT

A planar discharge plasma display device which can be easily manufactured and has low optical loss includes a front and a rear plate, a plurality of anode signal lines and cathode signal lines arranged in an X-Y matrix on the rear plate and insulated so as not to be exposed to a discharge space. Anodes and cathodes protrude from the anode signal lines and cathode signal lines, respectively, near the intersections of the anode signal lines and the cathode signal lines. Barrier ribs are stacked on the anode signal lines and lodged between the anode signal lines and the front plate.

4 Claims, 2 Drawing Sheets

PLASMA DISPLAY DEVICE

BACKGROUND OF THE INVENTION

The present invention relates to a plasma display device, and more particularly to a planar discharge plasma display device.

Generally, as shown in FIG. 1, a direct current (DC) plasma display device (hereinafter, referred to as a PDP) is formed in such a manner that a plurality of anodes 30 and cathodes 40 are arranged on an X-Y matrix on each inner surface of two parallel substrate 10 and 20. Barrier ribs 60 for preventing cross-talk between anodes 30 on the upper side are formed with a predetermined height. As described above, in such a PDP, the anodes 30 and cathodes 40 are exposed to an inner space filled with discharge gas, so that a DC discharge is generated between the exposed upper anodes 30 and lower cathodes 40, i.e., at a pixel, by a DC voltage sequentially supplied to each vertically and horizontally disposed anode and cathode. When a discharge occurs between a cathode and an anode, the discharge light is composed of a negative glow on the cathode side and a positive column on the anode side. Between them, the negative glow is used as a light for monochrome image display, and the positive column is used as an ultraviolet source for exciting an color phosphor.

The disadvantage of the conventional PDP is that the luminance deteriorates because the discharge light ray transmits a transparent anode. Moreover, since the anodes 30 and the cathodes 40 which constitute pixels are disposed on both the front and rear plates 10 and 20, the fabrication process is difficult and complicated.

SUMMARY OF THE INVENTION

It is an object of the present invention to provide a plasma display device which has a high optical efficiency and can be easily manufactured.

To achieve the object of the present invention, in a plasma display device of a matrix driving type comprising a front plate and a rear plate, a plurality of anode signal lines and cathode signal lines are arranged in the form of an X-Y matrix on the rear plate and insulated so as not to be exposed to a discharge space, anodes and cathodes exposed to the discharge space are drawn out from the corresponding signal line near the intersection of the anode and cathode signal lines, and barrier ribs are provided above and parallel to the anode signal lines.

In the present plasma display device, since anodes and cathodes are provided together on the rear plate, discharge occurs in the planar direction, and the generated discharge light is transmitted to the front plate with a high optical transmissibility.

BRIEF DESCRIPTION OF THE DRAWINGS

The above object and other advantages of the present invention will become more apparent by describing the preferred embodiment of the present invention with reference to the attached drawings, in which.

DETAILED DESCRIPTION OF THE INVENTION

Figure 1:
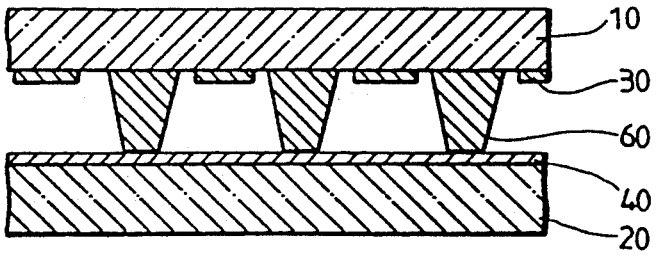
FIG.1(PRIOR ART)
FIG. 1 is a schematic cross-sectional view of a conventional plasma display device.
Figure 2:
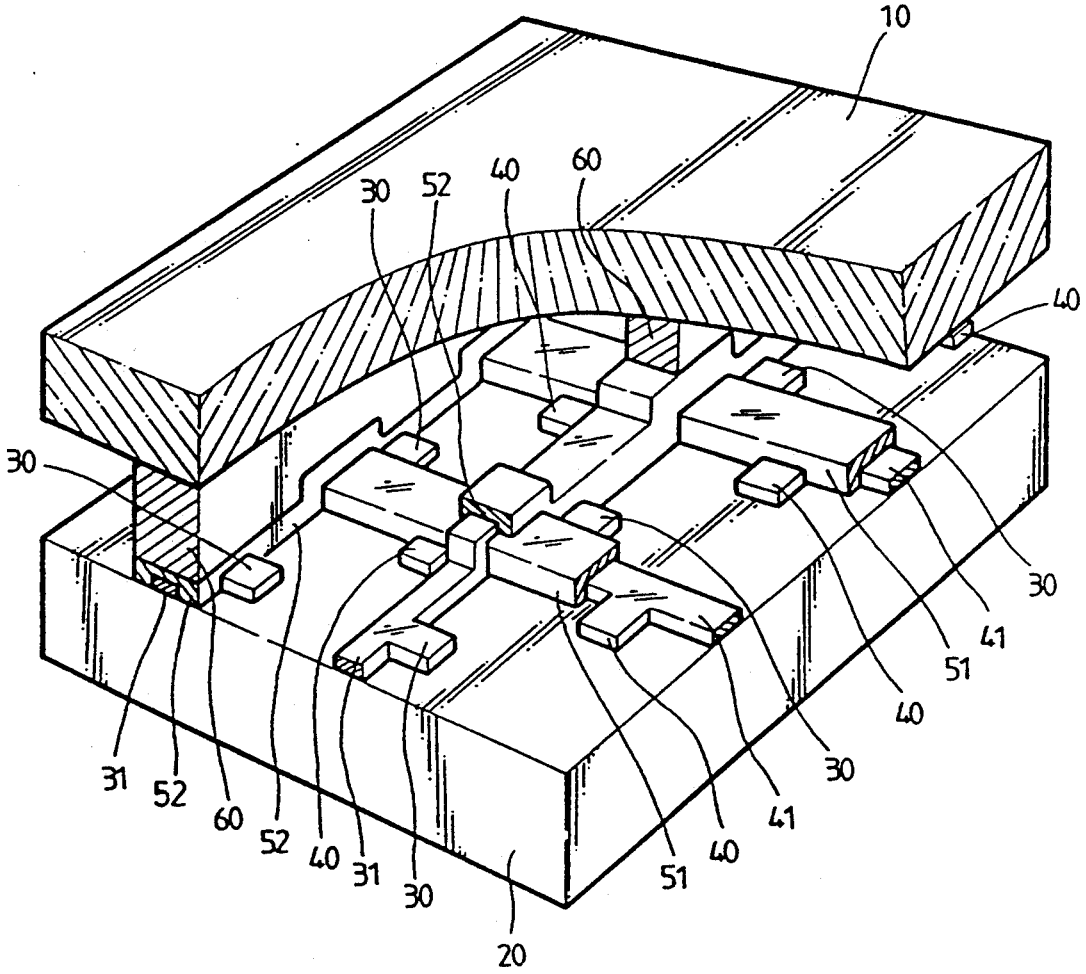
FIG. 2 is a cut-away view of an embodiment the PDP according to the present invention.

A plasma display device of the present invention has the structure shown in FIG. 2.

A transparent front plate 10 and an opposing rear plate 20 are spaced at a predetermined distance, while a plurality of anode signal lines 31 and cathode signal lines 41 are in the form of an X-Y matrix on the rear plate 20. At this time, the both sets of signal lines 31 and 41 are insulated from the discharge space by the respective upper insulating layers 52 and 51. A discharge electrode, e.g., an anode 30 and a cathode 40, is extruded and extended from the signal lines 31 and 41 with a constant pitch interval (between adjacent signal lines), and is exposed to the discharge space. Barrier ribs 60 of a specified height are formed over and parallel to anode signal lines 31. At this time, if the insulating layer 52 is formed by overlapping a thick layer print, the barrier ribs 60 and the insulating layer 52 (formed over anode signal lines 31) can be jointly formed as one unified body.

Figure 3:
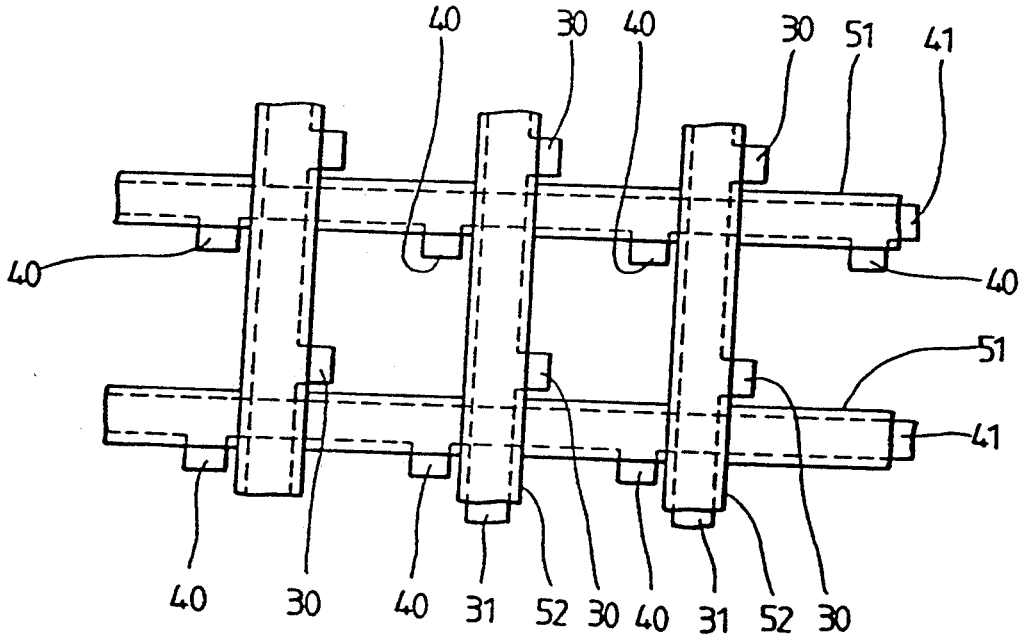
FIG. 3 is a top plan view of the PDP according to the present invention shown in FIG. 2.

Referring to FIG. 3, the plasma display device of the present invention having the aforementioned structure comprises a pixel in which an anode 30 and a cathode 40 are spaced apart from each other at a predetermined distance near each intersection of an opposing anode signal line 31 and cathode signal line 41. Both signal are insulated from each other. Accordingly, each signal line is selected by sequentially supplied scanning signals, thereby causing a discharge between the corresponding anode 30 and cathode 40, which is carried out in the planar direction along the rear plate. The discharge generates a discharge light which is transmitted to the front plate, to be visualized.

In the aforementioned plasma display device of the present invention, discharge is in the planar direction, inhibiting the optical loss due to the transmission of the discharge light through a transparent anode as in the conventional device. Accordingly, the optical efficiency of the present invention is higher than that of the aforementioned conventional plasma display device. The process for manufacturing the plasma display device of the present invention is simpler than that of the conventional plasma display device, because of its structural characteristics. That is, the anodes, cathodes, and barrier ribs can be jointly formed as one unified body on the rear plate, which improves the manufacturing process. Moreover, contrary to the conventional plasma display device using indium tin oxide (ITO), the anode, whose material can be a metal paste or of a similar material having conductivity as good as the cathode, is formed by a print method, thereby improving operation. Moreover, since the line resistance of the anode is lower than that of the conventional one, the locally unbalanced luminance on a screen due to a discharge voltage variation can be inhibited.

As described above, the embodiment of the present invention is limited to a very simple structure among various complex plasma display devices applicable to the present invention, but actually the specifically preferred application is to a very complex, and particularly a high density, image display device. It is inevitable that without deviating from the basic technical idea pursued by the present invention, many PDP fabrication method are within the scope of the present invention.

What is claimed is:

1. A plasma display device of a matrix driving type comprising:

a transparent front plate and a rear plate;

a plurality of both anode signal lines and cathode signal lines arranged in the form of an X-Y matrix on said rear plate and insulated so that the plurality of both signal lines are protected from exposure to a discharge space;

anodes and cathodes protruding from the corresponding signal lines near the intersections of said anode signal lines and said cathode signal lines and exposed to the discharge space, the protrusion of said anodes and said cathodes being in a plane parallel to a plane of said transparent front and rear plates; and barrier ribs provided between said anode signal lines and said front plate.

2. A plasma display device as claimed in claim 1, wherein said anode signal lines and said cathode signal lines are covered with respective insulating layers, and each of said barrier ribs is stacked on an insulating layer which covers an anode signal line and each of said barrier ribs is arranged parallel to said anode signal lines.

3. A plasma display device as claimed in claim 1, wherein each of said barrier ribs is integrally formed with the insulating layer.

4. A plasma display device comprising:

a transparent front plate and a rear plate;

a plurality of insulated cathode signal lines arranged on said rear plate;

a plurality of insulated anode signal lines arranged orthogonal to said cathode signal lines on said rear plate;

barrier ribs disposed above and along said anode signal lines;

anodes and cathodes protruding into a discharge space from said anode signal lines and said cathode signal lines such that said anodes are perpendicular to said cathodes and such that discharge between said anodes and cathodes occurs in a planar direction along said rear plate thus increasing optical efficiency.

* * * * *